US005782655A

United States Patent [19]

Stefaniu et al.

[11] Patent Number: 5,782,655

[45] Date of Patent: Jul. 21, 1998

[54] MINIATURE SHUNT CONNECTOR WITH ANTI-OVERSTRESS CONTACT ELEMENT AND METHOD OF COMMONING A PAIR OF ADJACENT TERMINAL POSTS

[76] Inventors: Michael V. Stefaniu, 165 Meadowbrook La., Lake Zurich, Ill. 60047; Raymond Silbernagel, 1008 Mattande La., Naperville, Ill. 60566; John T. Scheitz, 117 Park Dr., R.R. #4, Barrington, Ill. 60010

[21] Appl. No.: 714,340

[22] Filed: Sep. 16, 1996

[51] Int. Cl.[6] ..... H01R 31/08

[52] U.S. Cl. ..... 439/510

[58] Field of Search ..... 439/510

[56] References Cited

U.S. PATENT DOCUMENTS

| | | | |
|---|---|---|---|
| 3,932,013 | 1/1976 | Yeager et al. | 439/510 |
| 4,383,724 | 5/1983 | Verhoeven | 439/510 |
| 4,602,834 | 7/1986 | Hahn et al. | 439/510 |
| 4,631,377 | 12/1986 | Imazeki et al. | 439/510 |
| 4,726,787 | 2/1988 | Stine | 439/510 |
| 4,820,194 | 4/1989 | Stine | 439/510 |
| 4,955,824 | 9/1990 | Pretchel et al. | 439/510 |
| 5,449,301 | 9/1995 | Hanna et al. | 439/510 |

*Primary Examiner*—P. Austin Bradley
*Assistant Examiner*—T. C. Patel
*Attorney, Agent, or Firm*—Jeffrey H. Canfield

[57] ABSTRACT

A miniature shunt connector for commoning a pair of adjacent terminal posts and a method for commoning a pair of adjacent terminal posts are provided. The shunt connector includes a housing formed of an insulating material which forms an internal contact cavity configured to receive an electrical shunt contact. A pair of terminal post receiving apertures communicate with the contact cavity to allow terminal post to be inserted therein. A surface feature is also formed in a wall of the contact for locking said contact element into said housing. An electrical shunt contact element is provided and configured to fit within the internal shunt cavity. The contact element is formed with two rear contact beams and two resilient front contact beams. The resilient front contact beams being provided with and anti-overstress feature in the form of flared ends configured to physically engage the contact housing. A shunt portion of the contact element provides an electrical short circuit between the contact beams.

12 Claims, 3 Drawing Sheets

MINIATURE SHUNT CONNECTOR WITH ANTI-OVERSTRESS CONTACT ELEMENT AND METHOD OF COMMONING A PAIR OF ADJACENT TERMINAL POSTS

BACKGROUND OF THE INVENTION

The present invention relates to a miniature shunt connector for commoning a pair of terminal posts. The shunt contact of the present invention includes an anti-overstress feature which prevents the contact from being permanently deformed and losing resiliency during repeated application of the shunt to various terminal posts.

Miniature shunts are well known in the art. Typically they are provided on printed circuit boards to provide limited selectability between signals. Such shunts generally comprise a dielectric housing having a contact cavity disposed therein. An electrical contact is inserted into the cavity and provides a means for electrically shorting a pair of terminal post inserted into the contact. The terminal posts extend from a printed circuit board and are connected to various electronic circuits on the board. A shunt is provided which can be inserted over adjacent terminal posts, electrically commoning the two posts, thereby coupling the electrical circuits attached to each post. Often a number of pairs of terminal posts are provided in a single terminal header, and depending on which pair of terminal posts are shunted, various circuit functions are performed. The miniature shunt allows solid, non-permanent connections to be made on the printed circuit board, allowing multiple circuit configurations to be alternately selected without requiring hardware changes to the printed circuit board.

In order to be effective, it is necessary that the shunt contact provide a firm electrical connection with the terminal posts inserted therein. Loose shunt contacts can give rise to a number of problems in the operation of the printed circuit board. In some environments vibration can be a problem., and loose contacts can have a tendency to fall off causing the printed circuit board to fail, or loose fitting contacts can result in poor contact with the terminal posts and causing intermittent problems with the operation of the printed circuit board. Thus, it is essential that a miniature shunt be provided with a contact element that provides a firm electrical contact with terminal posts inserted therein.

Typical miniature shunt contacts are formed of a single metal stamping having two pairs of cantilevered contact beams configured to receive a pair of terminal posts therebetween, and a shunt section providing an electrical short circuit between all four contact beams. Generally, the spacing between the two beams of each pair is less than the width of the terminal post to be inserted therein. Thus, when a terminal post is inserted, the beams are deflected outward to accommodate the post. Elastic forces within the cantilevered beams tend to force the beams back toward their rest position against the terminal posts, thereby forming a firm contact with the terminal posts.

From the nature of the application, it is clear that miniature shunts must be robust enough to survive repeated insertions over various terminal posts. A problem encountered with miniature shunt connectors is that the elastic forces which hold the contact beams against the terminal posts diminish after repeated insertions over large terminal posts. The points on the shunt contact where the cantilevered beams deflect tend to become permanently bent outward due to overstressing of the contact. After several insertion operations, sufficient contact between the cantilevered beams and the terminal posts is no longer maintained, and the circuit board employing the shunt will begin to malfunction. The problem of overstressing the contact element is widespread, and has caused manufacturers who use miniature shunt connectors to develop specifications for the minimum acceptable withdrawal force for removing the shunt connector from terminal after a specified number of insertions and withdrawals. One such specification requires a miniature shunt connector to accept 0.0213" square terminal posts. The shunt connector is inserted over and removed from the 0.0213" terminal posts ten times. On an eleventh insertion, the shunt connector is inserted over 0.0181" square terminal posts. To meet the specification, the shunt connector must grip the smaller terminal posts with sufficient force that a minimum withdrawal force of 100 grams is required to remove the shunt connector from the terminal posts.

As such tests make clear, a need exists for a miniature shunt connector for commoning a pair of terminal posts which prevents the contacts from being overstressed during repeated insertion over various sized terminal posts. Such miniature shunt providing a reliable connection between the shunt contact element and inserted terminal posts, and further providing a consistent contact force against said terminal posts over the life of the shunt.

SUMMARY OF THE INVENTION

In light of the prior art described above, one of the main objectives of the present invention is to provide a reliable miniature shunt connector for commoning a pair of adjacent terminal posts.

A further object of the present invention is to provide a miniature shunt connector with a resilient electrical contact member which will maintain its original orientation after numerous insertions of terminal posts.

Another objective of the present invention is to provide a miniature shunt connector with a means for preventing the overstressing of the shunt's electrical contact member.

Still another objective of the present invention is to provide a miniature shunt connector which will provide a consistent amount of contact force against inserted terminal posts after multiple insertions of oversized terminal posts.

Yet another objective of the present invention is to provide a miniature shunt capable of being inserted onto and removed from a first pair of terminal posts at least ten times, then still requiring a minimum withdrawal force of 100 grams to remove the shunt connector when later inserted onto a second, smaller pair of terminal posts.

All of these objectives, as well as others that will become apparent upon reading the detailed description of the presently preferred embodiment of the invention, are met by the miniature shunt connector with an anti-overstress contact element described herein. In the presently preferred embodiment a miniature shunt is formed of a dielectric contact housing and a metallic contact element. The housing is formed with an internal contact cavity for receiving the contact element. Two terminal post receiving apertures are formed in the bottom surface of the housing, and communicate with the contact cavity. The terminal post receiving apertures allow a pair of terminal posts to be inserted into the housing and make physical contact with the contact element. A retaining surface feature, in the preferred embodiment a notched centering member, is formed in the front wall of the housing within the contact cavity.

The contact element is formed of a single metallic stamping and has a lower shunt portion which electrically short circuits a pair of rear contact beams and a pair of cantilevered forward contact beams. The forward and rear contact beams are arranged in pairs such that each forward contact beam is opposite one of the rear contact beams forming a terminal post insertion passageway therebetween. Rounded contact ridges are formed approximately half way down the length of each beam, protruding into the passageways between the two pairs of contact beams, and forming a constriction therein. The rear contact beams attach to an upper support which short circuits the two rear contact beams. Both the lower shunt portion and the upper stabilizing member are sized to engage the walls of the contact cavity to hold the contact element firmly in place. An upper portion of each the forward contact beam is bent outwardly away from the rear contact beams at a point just above the contact ridge. A locking tab extends from the lower shunt portion between the two rear contact beams. The locking tab is bent forward such that the tab extends inward toward the center of the contact element.

The contact element is inserted into the housing through an opening on the top surface of the housing opposite the post receiving apertures, with the front contact beams adjacent the front wall of the housing, one on each side of the centering member. When the contact element is fully inserted, the lower shunt portion abuts the bottom surface of the housing and generally engages all four sidewalls of the housing. Similarly, the upper stabilizing member engages the rear and two side walls of the housing at the upper end of the housing near the contact insertion opening. The locking tab engages the notch in the centering member, locking the contact into the housing. The angled portions of the forward contact beams are configured so that the ends of the contact beams press against the front wall of the housing. In this configuration, the terminal post engagement ridges form restrictions in the passageway between the forward and rear contact beams. These restrictions form the primary contact area between the contact element and the terminal posts when the shunt connector is inserted over a pair of terminal posts. Upon insertion of the connector over a pair of terminal posts, the forward contact beams are forced outward toward the front wall of the housing. The cantilevered forward contact beams act as springs, absorbing the insertion force of the terminal posts by deflecting towards the front wall of the housing. The spring force of the deflected forward contact beams acts in a direction perpendicular to the front wall of the housing, and forces the forward contact beams against the terminal posts. In this way overstressing of the cantilevered forward contact beams is limited, and consistent contact force is applied from the contact beams to the terminal posts. When the terminal posts are removed, the angled portions of the forward contact beams press against the front wall of the housing, and force the cantilevered beams back to their original position. Because of the angled portions of the forward contact beams, deflection of the beams is absorbed at two points rather than only at the point of attachment to the lower shunt portion as was the case in prior contact designs. This helps relieve overstressing of the contact beams, and prevents permanent deformation of the contact beams when the shunt connector is inserted over wide terminal posts. Thus, a more reliable miniature shunt connector is provided.

A method of electrically commoning a pair of adjacent terminal posts is also provided. The method includes the steps of providing a contact housing and contact element as described above, and inserting the contact element into the housing to form a miniature shunt connector. The adjacent terminal posts are short circuited by sliding the miniature shunt connector over the terminal posts.

DETAILED DESCRIPTION OF THE PRESENTLY PREFERRED EMBODIMENTS

The present invention is for a miniature shunt connector having an anti-overstress feature which prevents the shunt contact element from deforming when over-sized terminal posts are inserted therein. The miniature shunt connector provides consistent contact force against inserted terminal posts after repeated insertions of oversized terminal posts.

Figure 1:
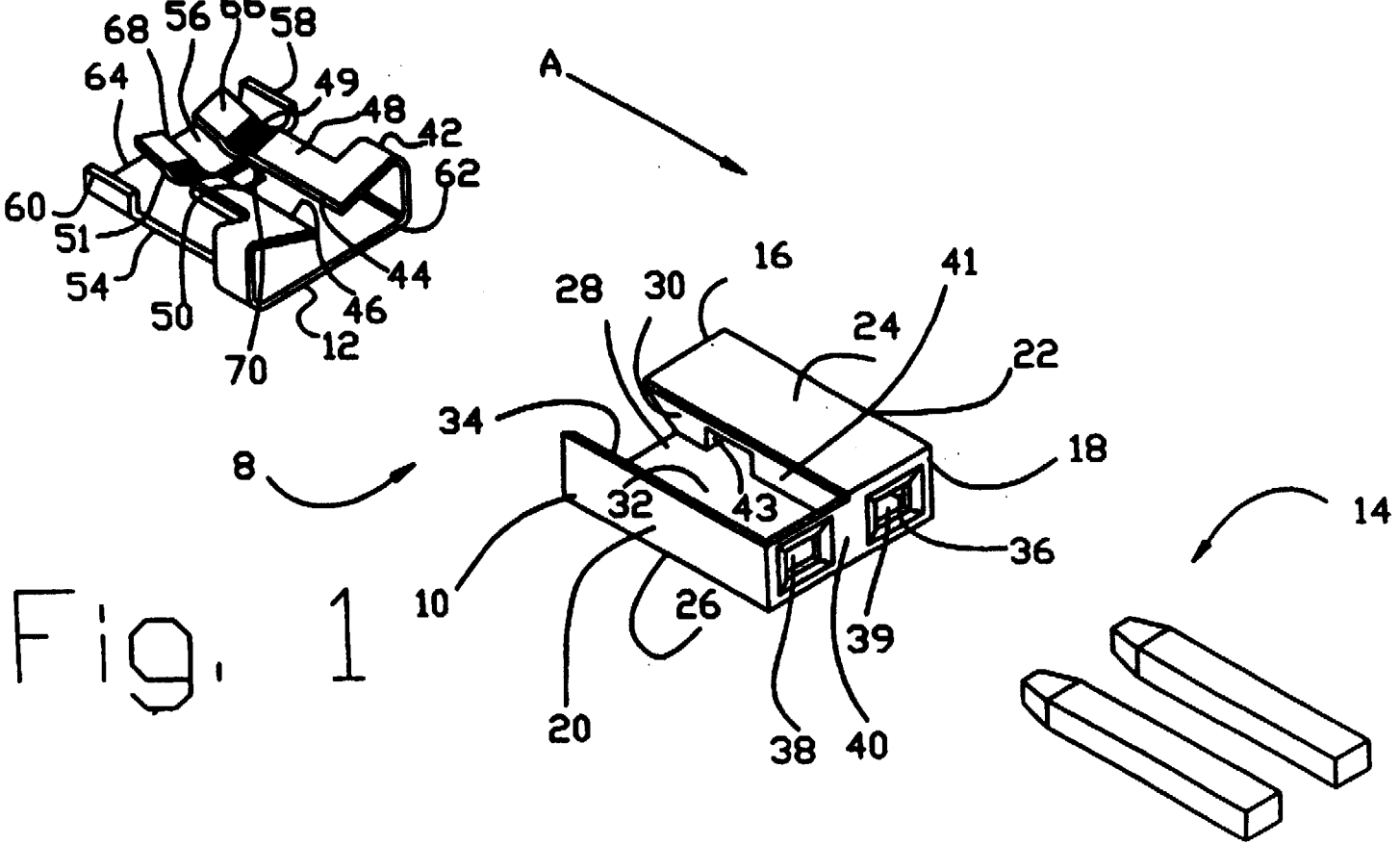
FIG. 1 is an exploded isometric view of a miniature shunt connector according to the present invention.

In FIG. 1 an exploded view of a miniature shunt connector 8 according to the present invention is shown, including a housing 10, a contact element 12, and a pair of terminal posts 14 over which the shunt connector is insertable. When assembled, the contact element 12 resides within the housing 10, and the housing 10 can be inserted over the terminal posts 14. The contact element 12 engages both terminal posts 14 and provides a short circuit between the posts thereby electrically commoning the two terminal posts 14.

The housing 10 is formed of an insulating material such as plastic, and is generally in the shape of a rectangular cube having top and bottom sides 16, 18, left and right sides 20, 22, and front and back sides 24, 26. The housing is formed with an internal contact cavity 28 for receiving the contact element 12, the cavity being defined by interior front and rear walls 30, 32 and interior side walls 34, 36. A pair of terminal post receiving apertures 38, 39 are formed in the bottom side 18 of the housing and communicate with the internal contact cavity 28. The two apertures 38, 39 are divided by a support post 40. The post receiving apertures 38, 39 allow the housing 10 to be inserted onto the terminal posts 14 so that the terminal posts engage the contact element 12. A centering member 41 having a notched portion 43 is formed in the front wall 30 of the contact cavity 28 for locking the contact element 12 into the housing 10.

In the preferred embodiment, the contact element 12 is stamped from a single sheet of conductive material formed of phosphor-bronze copper alloy #521, extra hard temper, 0.0086" thick. First and second edges 44, 46 of the contact element 12 are folded over themselves in a staple-like fashion. First and second forward cantilevered contact beams 48, 50 extend upward from the lower shunt portion 42, forming the first and second edges 44, 46. A pair of rear contact beams 52, 54 (rear contact beam 52 cannot be seen in FIG. 1, as it is behind forward contact beam 48, however, rear contact beam 52 is shown in the section views of FIGS. 2 and 3) extend upward from the lower shunt portion 42 directly behind and generally parallel to the first and second cantilevered forward contact beams 48, 50. The rear contact beams 52, 54 are joined at the top by an upper stabilizing member 56 extending perpendicular to the rear contact beams 52, 54. The upper stabilizing member 56 extends laterally beyond the rear contact beams 52, 54, and folds over at each end 58, 60 in a manner similar to the lower shunt portion 42, except that the length of the upper stabilizing member 56 is not coextensive with that of the lower shunt portion 42. Each end 58, 60 of the upper stabilizing member extends to approximately the width of the contact cavity 28 of the housing 10, and no further. The distance between the bottom edge 62 and the top edge 64 of the contact element 12 is approximately equal to the length of contact cavity 28 in housing 10. Both the forward 48, 50 and rear 52, 54 contact beams are formed with rounded contact ridges 49, 51. The forward contact beams 48, 50 are formed with means for preventing overstressing of the contact element 12, in the form of outwardly angled upper ends 66, 68 located above the contact engagement ridge 49. Finally, a locking tab 70 extends from the lower shunt portion 42, between the rear contact beams 52, 54. The locking tab 70 is bent forward toward the center of the contact element.

Figure 2:
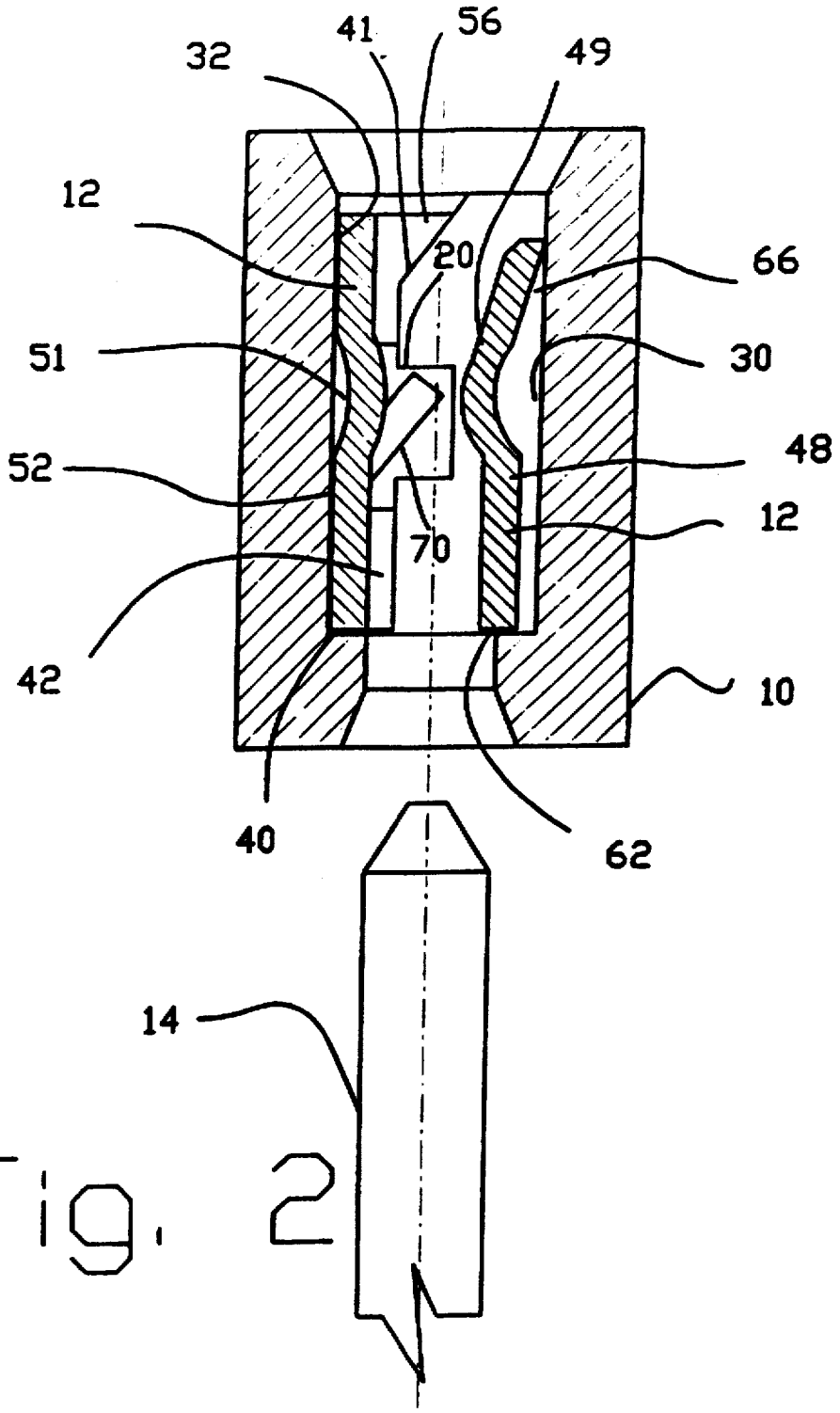
FIG. 2 is a section view of the assembled shunt connector of FIG. 1 taken along the insertion axis of one of the terminal posts.
Figure 3:
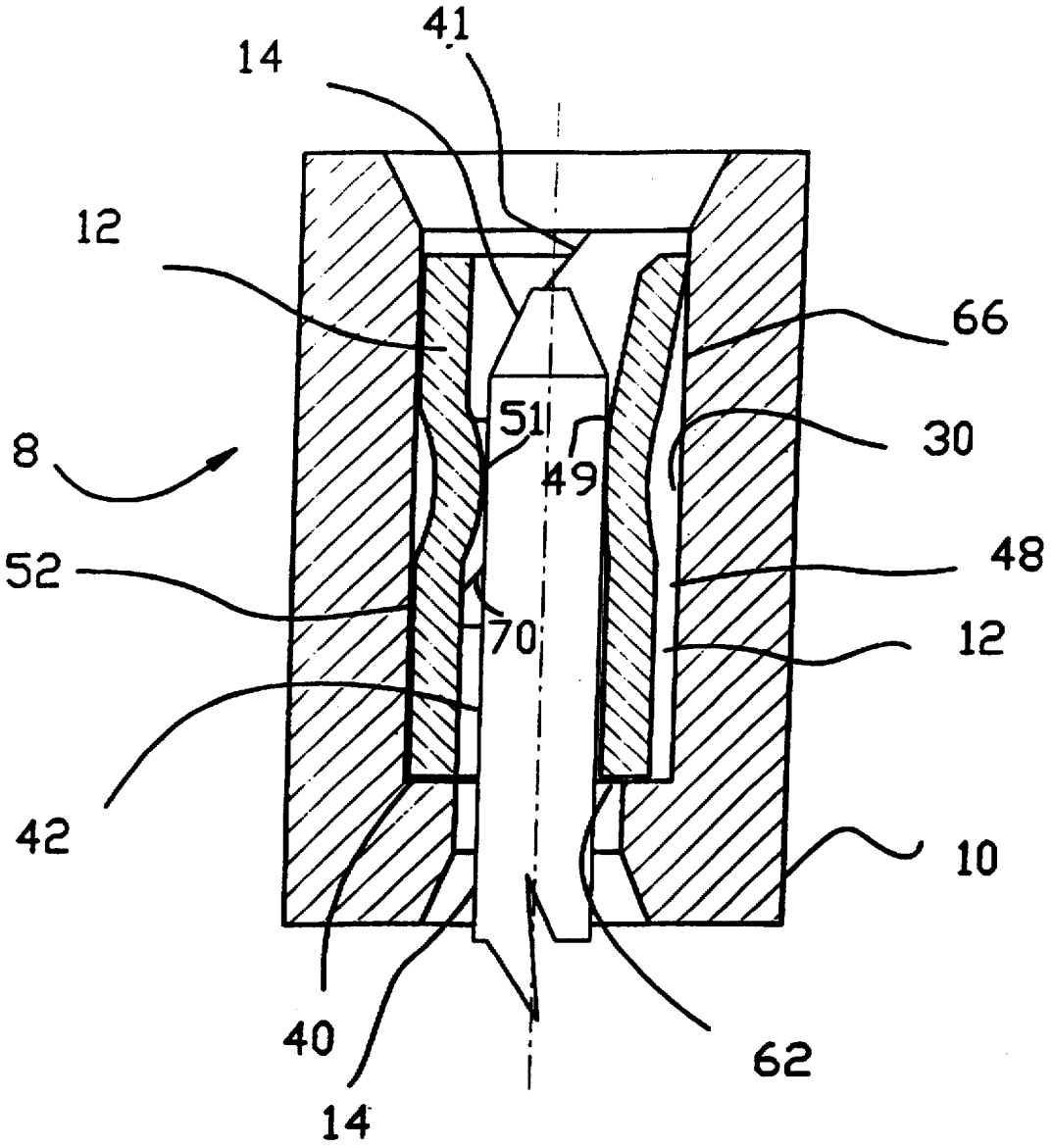
FIG. 3 is the same section view as FIG. 2, but having a terminal post inserted into the shunt connector.

A miniature shunt connector 8 is assembled by sliding contact element 12 into the contact cavity 28 of the housing 10 as indicated by arrow A in FIG. 1. Referring now to FIGS. 2 and 3, cross sectional views of an assembled miniature shunt connector 8 according to the present invention taken along the insertion axis of one of the terminal posts 14. FIG. 2 shows a shunt connector 8 prior to being inserted over a terminal post 14, and FIG. 3 shows the same miniature connector 8 inserted over a terminal post 14. When the contact element 12 is fully inserted into the housing 10, the bottom edge 62 of the contact element 12 abuts the support post 40, and locking tab 70 engages the notched portion 43 of the centering member 41 to lock the contact element in the housing. The lower shunt portion 42 of the contact element 12 is sized generally to engage all four interior walls 30, 32, 34, 36 of the contact cavity 28, and the upper stabilizing member 56 engages the rear wall 32 and both side walls 34, 36, so that the contact fits tightly within the housing 10. Both the cantilevered forward contact beams 48, 50 and the rear contact beams 52, 54 extend generally parallel to the front and rear walls 30, 32 of the contact cavity 28. However, both of the cantilevered forward contact beams 48, 50 are bent forward so that the upper ends 66, 68 of the forward contact beams 48, 50 are angled outward so that they extend forward until they physically engage the front wall 30 of the contact cavity 28.

Comparing FIGS. 2 and 3, it can be seen that when the miniature shunt connector is not inserted over terminal posts 14, the distance between the contact ridges 49, 51 on the forward contact beams 48, 50 and the rear contact beams 52, 54 is less than the width of the terminal post 14. Thus, when the miniature shunt connector 8 is inserted onto a pair of terminal posts 14, the contact ridges 49, 51 are forced apart causing the forward contact beams 48, 50 to deflect toward the front wall 30 of the contact cavity 28. The bent upper ends 66, 68 of the forward contact beams 48, 50 pressing against the front wall 30 of the contact cavity 28 help to supply an increased contact force between the forward contact beams 48, 50 and the terminal posts 14. As the forward contact beams 48, 50 move outward, the angled upper ends 66, 68 tend to flatten out against the front wall 30 of the contact cavity 28, as can be seen in FIG. 3. Elastic forces within the contact element 12 tend to force the cantilevered forward contact beams 48, 50 back toward their at rest position. When deflected in this manner, the forward contact beams 48, 50 act as compressed springs, pressing the contact ridges 49, 51 back against the terminal posts, thereby forming a firm electrical contact. In the preferred embodiment, the spring forces pressing the cantilevered forward contact beams 48, 50 against the terminal posts are sufficiently strong so that a withdrawal force in the range of 75–125 grams is required to remove the miniature shunt connector from a pair of 0.0181" square terminal posts. Also in the preferred embodiment, the housing 10 and contact element 12 are configured such that the miniature shunt connector can be inserted over the terminal posts in either the forward direction (bottom side 18 first) or reverse direction (top side first). In either case, the edges 44, 46 of the contact element 12 are deflected outward, and the forward contact beams 48, 50 behave as described.

The angled upper portions of the forward contact beams 66, 68 act to prevent overstressing of the contact element 12 when excessively wide terminal posts 14 are inserted into the miniature shunt connector. In prior art miniature shunt connectors forward contact beams were not angled outward to contact the housing wall. All of the stress from accepting wide terminal posts had to be absorbed by the lower shunt portion alone. Thus it was easier to overstress the lower shunt portion and permanently deform the contact element. Once deformed in such manner, the contact element supplies less contact force against the terminal posts, especially if narrower posts are later inserted. With the present embodiment, the stress from accepting overly wide terminal posts is distributed between the lower shunt portion 42, and the bent upper ends of the forward contact beams 66, 68. Having the upper ends of the contact beams 66, 68 braced against the forward interior wall 30 of the contact cavity 28 provides additional spring force to the cantilevered forward contact beams 48, 50 and relieves some of the deflecting stress from the lower shunt portion 42. Furthermore, when the miniature shunt connector is inserted over excessively wide terminal posts 14, the front and rear walls 24, 26 flex outward. Elastic forces within the housing 10 provide additional spring forces to urge the forward contact beams 48, 50 against the terminal post 14. Thus, the present invention provides a means for limiting overstressing of the contact element 12, and maintaining a firm contact between the contact element 12 and the terminal posts 14.

It should be understood that various changes and modifications to the presently preferred embodiment described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An electrical contact for commoning a pair of adjacent terminal posts comprising:

a shunt portion;

first and second rear contact beams extending from said shunt portion; and first and second front contact beams extending from said shunt portion opposite said rear beams, said first and second front contact beams each having an outwardly flared end portion for engaging a front wall of a contact housing such that said terminal posts, inserted between said front and rear contact beams, compress said front contact beams between said front wall of said contact housing and said terminal posts, said compressed front contact beams providing a biasing force against said terminal posts.

2. The electrical contact of claim 1 wherein said contact is made from a single piece of conductive material having a first edge and a second edge.

3. The electrical contact of claim 2 wherein said first front contact beam is formed adjacent to said first edge, and said second front contact beam is formed adjacent to said second edge said first edge being folded over upon itself to position said first front contact beam opposite said first rear contact beam, and said second edge is folded over upon itself to position said second front contact beam opposite said second rear contact beam.

4. The electrical contact of claim 2 wherein said contact is formed of phosphor bronze copper alloy.

5. The electrical contact of claim 1 wherein the distance between said front and rear contact beams is less than the width of said terminal posts so that said front beams must deflect outwardly to accommodate said terminal posts.

6. A miniature shunt connector for commoning a pair of adjacent terminal posts comprising:

a housing formed of an insulating material, said housing defining an internal contact cavity configured to receive an electrical shunt contact, said housing further defining a pair of terminal post receiving apertures in communication with said contact cavity; and a shunt contact configured to fit within said internal contact cavity, said contact having two sets of front and rear contact beams electrically short circuited to one another, each set of front and rear contact beams being arranged to accept a terminal post therebetween, said front contact beams each having an outwardly flared end contacting an internal front wall of said housing such that said terminal posts, inserted between said front and rear contact beams, compress said front contact beams between said internal front wall and said terminal posts, said compressed front contact beams providing a biasing force against said terminal posts.

7. The miniature shunt connector of claim 6 wherein the distance between said front and rear beams is less than the width of said terminal posts so that said front contact beams must deflect outwardly to accommodate said terminal posts.

8. A method of commoning a pair of terminal posts on a printed circuit board comprising the steps of:

providing a miniature shunt contact housing;

providing a contact element configured to fit within said contact housing, said contact element having a shunt portion for providing an electrical short between two pairs of front and rear contact beams;

bending said front contact beams so they will physically engage said contact housing when inserted therein;

inserting said contact element into said housing; and inserting said contact housing and said contact element onto said terminal posts such that said terminal posts compress said front contact beams between said contact housing and said terminal posts, said compressed front contact beams providing a biasing force against said terminal posts.

9. The method of claim 8 wherein said housing is formed with a surface feature for locking said contact element into said housing.

10. The method of claim 9 wherein said surface feature is in the form of a notch formed in a back wall of said contact housing, and said contact element is formed with a locking tab for engaging said notch.

11. The method of claim 8 wherein said housing is formed with two terminal post receiving apertures in communication with said contact element.

12. The method of claim 8 wherein the distance between said front and rear contact beams is less than the width of said terminal posts.

* * * * *